US009068461B2

(12) United States Patent
Laurello et al.

(10) Patent No.: US 9,068,461 B2
(45) Date of Patent: Jun. 30, 2015

(54) TURBINE ROTOR DISK INLET ORIFICE FOR A TURBINE ENGINE

(75) Inventors: Vincent P. Laurello, Hobe Sound, FL (US); Ching-Pang Lee, Cincinnati, OH (US)

(73) Assignee: SIEMENS AKTIENGESELLSCHAFT, München (DE)

( * ) Notice: Subject to any disclaimer, the term of this patent is extended or adjusted under 35 U.S.C. 154(b) by 688 days.

(21) Appl. No.: 13/212,263

(22) Filed: Aug. 18, 2011

(65) Prior Publication Data

US 2013/0045083 A1 Feb. 21, 2013

(51) Int. Cl.
*F01D 5/08* (2006.01)

(52) U.S. Cl.
CPC ..... *F01D 5/087* (2013.01)

(58) Field of Classification Search
CPC ..... F01D 5/08; F01D 5/081; F01D 5/082; F01D 5/084; F01D 5/085; F01D 5/087; F01D 5/18; F05D 2260/20; F05D 2260/201; F05D 2260/202; F05D 2260/203; F05D 2260/221
USPC ..... 415/115, 116, 95, 96 R, 97 R
See application file for complete search history.

(56) References Cited

U.S. PATENT DOCUMENTS 4,236,869 A 12/1980 Laurello
4,415,310 A * 11/1983 Bouiller et al. ..... 416/95
4,553,901 A 11/1985 Laurello
4,643,638 A 2/1987 Laurello
4,648,792 A 3/1987 Baran, Jr. et al.
4,653,267 A 3/1987 Brodell et al.
4,815,272 A 3/1989 Laurello
5,419,681 A 5/1995 Lee et al.
5,458,461 A 10/1995 Lee et al.
5,591,007 A 1/1997 Lee et al.
5,651,662 A 7/1997 Lee et al.
5,660,525 A 8/1997 Lee et al.
5,700,130 A * 12/1997 Barbot et al. ..... 416/95
5,957,660 A * 9/1999 Evans et al. ..... 416/97 R
6,243,948 B1 * 6/2001 Lee et al. ..... 29/889.1
6,595,741 B2 * 7/2003 Briesenick et al. ..... 415/116
6,659,716 B1 12/2003 Laurello et al.
6,663,346 B2 * 12/2003 Munsell et al. ..... 416/97 R
6,732,530 B2 5/2004 Laurello et al.
6,773,225 B2 8/2004 Yuri et al.
6,786,488 B2 9/2004 Laurello et al.
6,837,676 B2 1/2005 Yuri et al.
7,017,349 B2 3/2006 Laurello et al.
7,510,376 B2 3/2009 Lee et al.
2009/0010751 A1 * 1/2009 McCaffrey et al. ..... 415/116

* cited by examiner

*Primary Examiner* — Nathaniel Wiehe
*Assistant Examiner* — Michael Sehn

(57) ABSTRACT

A turbine rotor body having at least one inlet orifice in fluid communication with a pre-swirl system such that the inlet orifice receives cooling fluids from the pre-swirl system is disclosed. The inlet orifice may be configured to reduce the relative velocity loss associated with cooling fluids entering the inlet orifice in the rotor, thereby availing the cooling system to the efficiencies inherent in pre-swirling the cooling fluids to a velocity that is greater than a rotational velocity of the turbine rotor body. As such, the system is capable of taking advantage of the additional temperature and work benefits associated with using the pre-swirled cooling fluids having a rotational speed greater than the turbine rotor body.

19 Claims, 3 Drawing Sheets

TURBINE ROTOR DISK INLET ORIFICE FOR A TURBINE ENGINE

FIELD OF THE INVENTION

This invention is directed generally to turbine engines, and more particularly to cooling fluid feed systems in rotor assemblies of turbine engines.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine blade assemblies to these high temperatures. As a result, turbine blades and turbine vanes must be made of materials capable of withstanding such high temperatures. Turbine blades, vanes and other components often contain cooling systems for prolonging the life of these items and reducing the likelihood of failure as a result of excessive temperatures.

Cooling fluids are typically supplied to a turbine rotor from a combustor. The cooling fluids flow from the combustor and into a pre-swirler configured to discharge the cooling fluids at a velocity equal to the velocity of the turbine rotor. Such a system reduces the relative velocity loss and pressure loss entering the rotating hole on the disk of the turbine rotor. Although such system enhances the efficiency of the system, a need exists for additional efficiencies to meet demands placed on the turbine engine cooling system.

SUMMARY OF THE INVENTION

This invention relates to a turbine rotor formed from a turbine rotor body having at least one inlet orifice in fluid communication with a pre-swirl system such that the inlet orifice receives cooling fluids from the pre-swirl system. The inlet orifice may be configured to reduce the relative velocity loss associated with cooling fluids entering the inlet orifice in the rotor body, thereby availing the cooling system to the efficiencies inherent in pre-swirling the cooling fluids to a velocity that is greater than a rotational velocity of the turbine rotor body. As such, the system is capable of taking advantage of the additional temperature and work benefits associated with using the pre-swirled cooling fluids having a rotational speed greater than the turbine rotor body. In at least one embodiment, the inlet orifice may include a diffuser ramp for reducing the relative velocity loss associated with cooling fluids entering the inlet orifice in the rotor body. The diffuser ramp may have numerous configurations for reducing the relative velocity loss.

The turbine rotor may be formed from a turbine rotor formed from a turbine rotor body having at least one cooling chamber forming a portion of a cooling system and having a plurality of rows of turbine blades extending radially from the turbine rotor body, wherein the plurality of rows form a plurality of stages of a turbine engine. The turbine rotor body may be rotationally coupled to one or more stationary components of the turbine engine such that during operation, the turbine rotor body is capable of rotating relative to the at least one stationary component. The cooling system may include at least one pre-swirl system configured to increase the velocity of cooling fluids within the cooling system to a speed that is at least equal to a rotational speed of the turbine rotor body. The pre-swirl system may exhaust cooling fluids at a velocity greater than a velocity of the turbine rotor during operation. The cooling system may include at least one inlet orifice in fluid communication with the pre-swirl system such that the inlet orifice receives cooling fluids from the pre-swirl system. The inlet orifice may include a diffuser ramp extending generally along an outer surface of the turbine rotor body such that the diffuser ramp extends from an intersection of the outer surface and the turbine rotor body into the turbine rotor body and terminates at the at least one inlet orifice, wherein a volume of the diffuser ramp increases moving from the intersection to the at least one inlet orifice.

The diffuser ramp of the inlet orifice may have a width at least as wide as a diameter of the inlet orifice. The diffuser ramp may have generally linear sides extending radially from the at least one inlet orifice. The diffuser ramp may have a generally linear bottom surface sloped radially inward to provide for radial diffusion. In another embodiment, the diffuser ramp of the inlet orifice may have generally curved sides extending radially from the inlet orifice to provide for axial diffusion.

At least a portion of the inlet orifice not formed by the diffuser ramp may include a transition section extending radially therefrom a distance greater than an outer diameter of the inlet orifice but less than an outermost extension of the diffuser ramp.

A channel forming the inlet orifice may be generally linear relative to a longitudinal axis of the channel. In another embodiment, the channel forming the inlet orifice may be generally curved relative to a longitudinal axis of the channel such that the channel is aligned with the entering fluid velocity vector. The diffuser ramp may be positioned such that a longitudinal axis of the diffuser ramp may be canted relative to a linear axis of the turbine rotor. In particular, the longitudinal axis of the diffuser ramp may be aligned with a resultant of a relative velocity vector and an axial velocity vector.

The inlet orifice may also include an outlet that includes an outlet diffuser. The outlet diffuser may be symmetrically wider than a channel forming the inlet orifice in a first direction, and the outlet diffuser may be asymmetrical wider than the inlet orifice in a second direction that is generally orthogonal to the first direction, as viewed along an inner surface at the outlet.

An advantage of this invention is that the diffuser ramp is configured to reduce the velocity loss of incoming cooling fluids to the velocity of the turbine rotor at the inlet orifices during turbine engine operation so that the cooling system may use pre-swirling cooling fluids at a velocity faster than the turbine rotor to benefit from a reduction in total relative temperature of the cooling fluid and a reduction in the rotor work required to receive the cooling fluids.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
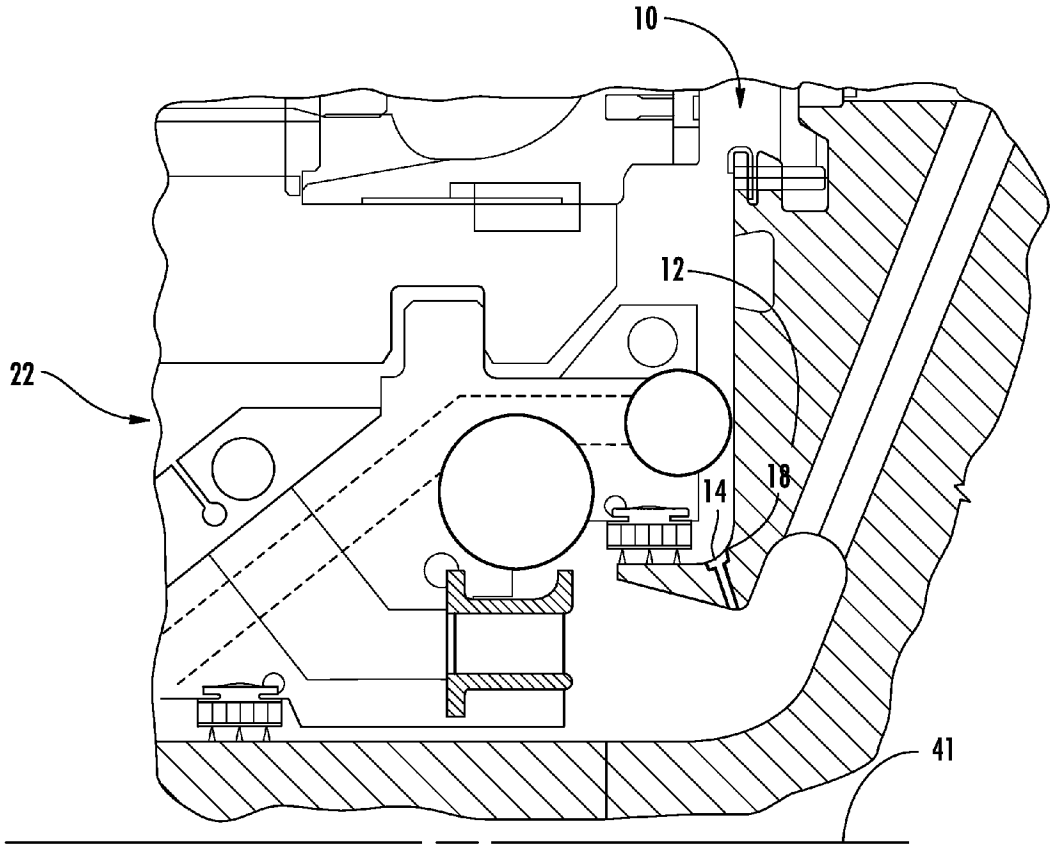
FIG. 1 is a cross-sectional side view of a portion of a turbine engine including a turbine rotor of this invention.

As shown in FIGS. 1-12, this invention is directed to a turbine rotor 8 formed from a turbine rotor body 10 having at least one inlet orifice 12 in fluid communication with a pre-swirl system 14 such that the inlet orifice 12 receives cooling fluids from the pre-swirl system 14. The inlet orifice 12 may be configured to reduce the relative velocity loss associated with cooling fluids entering the inlet orifice 12 in the rotor body 10, thereby availing the cooling system 16 to the efficiencies inherent in pre-swirling the cooling fluids to a velocity that is greater than a rotational velocity of the turbine rotor body 10. As such, the system 16 is capable of taking advantage of the additional temperature and work benefits associated with using the pre-swirled cooling fluids having a rotational speed greater than the turbine rotor body 12. The inlet orifice 12 may include a diffuser ramp 18 for reducing the relative velocity loss associated with cooling fluids entering the inlet orifice 12 in the rotor body 10. As discussed in detail below, the diffuser ramp 18 may have numerous configurations for reducing the relative velocity loss.

The turbine rotor 8 may be formed from a turbine rotor body 10 having at least one cooling chamber 20 forming a portion of a cooling system 16 and having a plurality of rows of turbine blades extending radially from the turbine rotor body 10, wherein the plurality of rows form a plurality of stages of a turbine engine. The turbine rotor body 10 may be configured to be rotationally coupled to at least one stationary component of the turbine engine such that during operation, the turbine rotor body 10 is capable of rotating relative to the stationary component 22. In at least one embodiment, the turbine rotor body may be generally cylindrical with turbine blades aligned in rows extending radially therefrom.

The cooling system 16 may also include at least one pre-swirl system 14 configured to increase the velocity of cooling fluids within the cooling system 16 to a speed that is at least equal to a rotational speed of the turbine rotor body 10. In at least one embodiment, the pre-swirl system 14 may be configured to pre-swirling the cooling fluids to a velocity that is greater than a rotational velocity of the turbine rotor body 10, thereby availing the cooling system 16 to the efficiencies inherent in pre-swirling the cooling fluids to a velocity that is greater than a rotational velocity of the turbine rotor body 10. The pre-swirl system 14 may be formed from a plurality of radially extending swirler vanes 54.

The cooling system 16 may also include at least one inlet orifice 12 in fluid communication with the pre-swirl system 14 such that the inlet orifice 12 receives cooling fluids from the pre-swirl system 14. The pre-swirl system 14 may have any appropriate configuration capable of delivering cooling fluids to the inlet orifice 12 at a velocity equal to or greater than a rotational velocity of the turbine rotor 8 at the inlet orifice 12.

The cooling system 16 may also include one or more inlet orifices 12 positioned in the turbine rotor body 10. The inlet orifices 12 may be positioned adjacent to the pre-swirl system 14 to receive cooling fluids from the pre-swirl system 14. The inlet orifices 12 may be aligned and generally positioned circumferentially forming a ring. The inlet orifices 12 may extend between an outer surface 24 of the turbine rotor body 10 and the cooling chamber 20. The cooling chamber 20 may be formed from one or more chambers, channels or other appropriate members configured to contain and direct cooling fluids.

Figure 2:
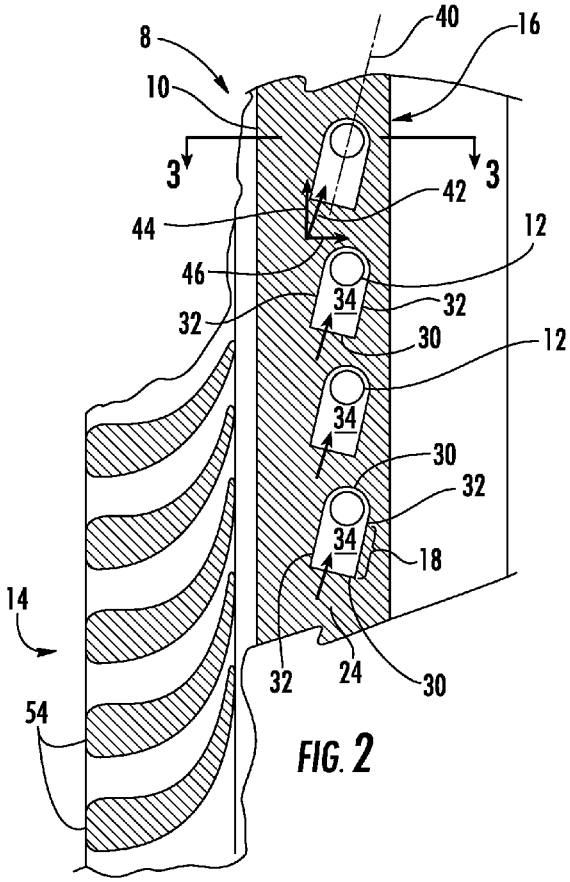
FIG. 2 is a detailed, top view of a portion of the turbine engine shown in FIG. 1 at line 2-2 showing a plurality of diffuser ramps configured for radial diffusion.
Figure 4:
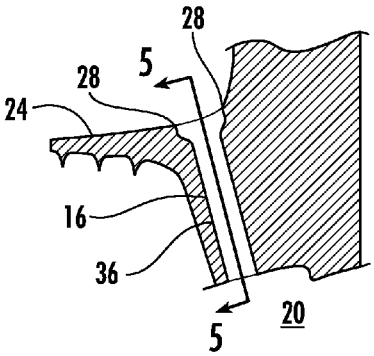
FIG. 4 is a cross-sectional view of an inlet orifice with diffuser ramp taken along section line 4-4 in FIG. 3.

One or more of the inlet orifices 12 may include a diffuser ramp 18 extending generally along the outer surface 24 of the turbine rotor body 10 such that the diffuser ramp 18 extends from an intersection 26 of the outer surface 24 and the turbine rotor body 10 into the turbine rotor body 10 and terminates at the inlet orifice 12. The volume of the diffuser ramp 18 may increase moving from the intersection 26 to the inlet orifice 12. As shown in FIGS. 2 and 4, the diffuser ramp 18 of the inlet orifice 12 may have a width at least as wide as a diameter of the inlet orifice 12. In particular, the diffuser ramp 18 may have a width that is wider than a diameter of the inlet orifice 12. At least a portion of inlet orifice 12 not formed by the diffuser ramp 18 may include a transition section 28 extending radially therefrom a distance greater than an outer diameter of the inlet orifice 12 but less than an outermost extension 30 of the diffuser ramp 18. In one embodiment, the transition section 28 may extend about 270 degrees around the inlet orifice 12. A width of the diffuser ramp 18 may be generally equal to a diameter of the inlet orifice 12 plus a width of a transition section 28 on opposing sides of the inlet orifice 12, as shown in FIG. 4.

Figure 3:
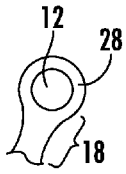
FIG. 3 is detailed view of an alternative diffuser ramp usable on the turbine rotor and configured for radial and axial.

The diffuser ramp 18 of the inlet orifice 12 may have generally linear sides 32 extending radially from the inlet orifice 12. The diffuser ramp 18 of the inlet orifice 12 may have a generally linear bottom surface 34. As such, the diffuser ramp 18 shown in FIGS. 2, 4 and 5 may be a generally wedge-shaped cavity. In another embodiment, as shown in FIG. 3, the diffuser ramp 18 may have aspects that are narrower than the inlet orifice 12. In particular, the diffuser ramp 18 may have generally curved sides 32 extending radially from the inlet orifice 12, thereby providing axial and radial diffusion.

Figure 5:
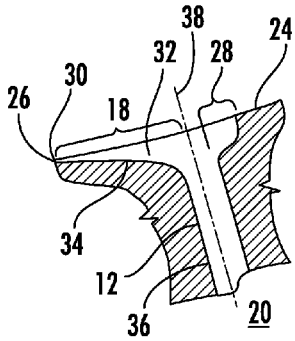
FIG. 5 is a cross-sectional view of the inlet orifice with diffuser ramp taken along section line 5-5 in FIG. 4.
Figure 6:
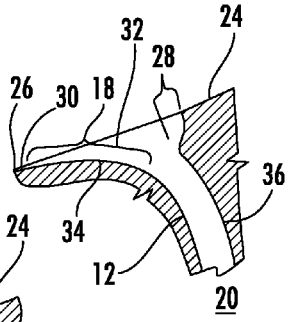
FIG. 6 is across-sectional view of an inlet orifice with an alternate diffuser ramp taken along section line 5-5 in FIG. 4.
Figure 7:
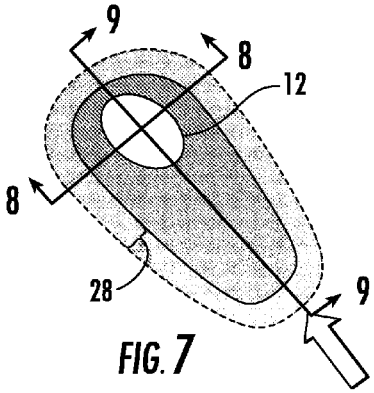
FIG. 7 is a top view of an inlet orifice in the turbine rotor.
Figure 8:
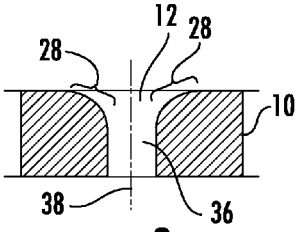
FIG. 8 is a cross-sectional view of the inlet orifice taken along section line 8-8 in FIG. 7.
Figure 9:
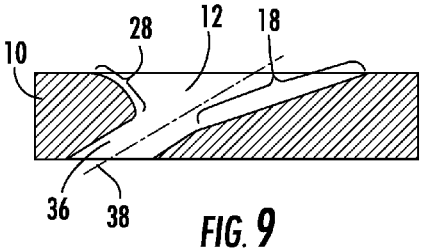
FIG. 9 is a cross-sectional view of the inlet orifice taken along section line 9-9 in FIG. 7, which is generally orthogonal to the section line 8-8.

As shown in FIG. 5, the inlet orifice 12 may include a channel 36 forming the inlet orifice 12 that is generally linear relative to a longitudinal axis 38 of the channel 36. The channel 36 may have any appropriate cross-sectional area. A cross-sectional shape of the channel 36 may remain constant or may differ along the length of the channel 36. The channel 36 may be positioned generally orthogonal to the outer surface 24 or may be positioned at an acute angle relative to the outer surface 24. In another embodiment, as shown in FIG. 6, the channel 36 forming the inlet orifice 12 may be generally curved relative to a longitudinal axis 38 of the channel 36. The curved channel 36 may be formed by electrical discharge machining (EDM), whereby the EDM affected material may be removed by abrasive slurry. The diffuser ramp 18 may be produced by EDM or other appropriate methods.

The diffuser ramp 18 on the turbine rotor body 10 may be positioned so as to reduce the relative velocity loss of cooling fluids entering the inlet orifice 12 at the outer surface 24. In one embodiment, as shown in FIG. 2, a longitudinal axis 40 of the diffuser ramp 18 is canted relative to a linear axis 42 of the turbine rotor 8. In at least one embodiment, the longitudinal axis 40 of the diffuser ramp 18 may be aligned with a resultant 42 of a relative velocity vector 44 and an axial velocity vector 46.

Figure 10:
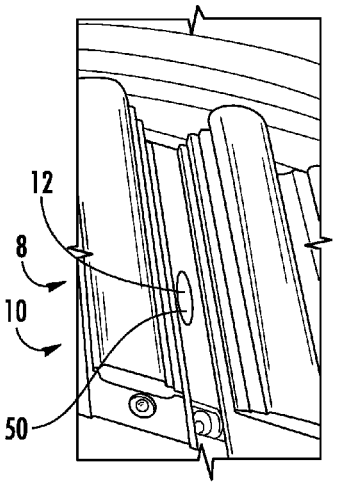
FIG. 10 is a partial perspective view of a turbine rotor with outlet of the inlet orifice.
Figure 11:
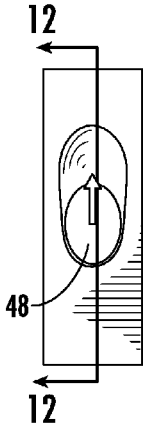
FIG. 11 is a bottom view of an outlet of the inlet orifice.
Figure 12:
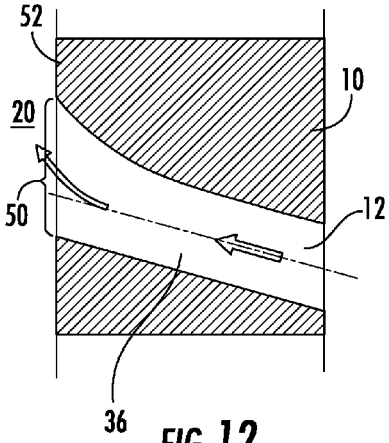
FIG. 12 is a cross-sectional view of the inlet orifice with an outlet diffuser taken along section line 12-12 in FIG. 11.

As shown in FIGS. 10-12, the inlet orifice 12 may include an outlet 48 coupled to the channel 36 for exhausting cooling fluids into the cooling chamber 20. The outlet 48 of the inlet orifice 12 may include an outlet diffuser 50. The outlet diffuser 50 may further reduce pressure losses by turning and diffusing the cooling fluids, which would allow a lower starting pressure and a higher pre-swirl velocity. The outlet diffuser 50 may be symmetrically wider than the channel 36 forming the inlet orifice 12 in a first direction, and the outlet diffuser 50 may be asymmetrically wider than the inlet orifice 12 in a second direction that is generally orthogonal to the first direction, as viewed along an inner surface 52 at the outlet. In at least one embodiment, the outlet 48 may exhaust cooling fluids into a dovetail cavity.

During use, cooling fluids, such as, but not limited to, air, may flow from a compressor and into the pre-swirl system 14. The pre-swirl system 14 may exhaust the cooling fluids at a velocity greater than or equal to a rotational velocity of the turbine rotor 18 at a location of the one or more inlet orifices 12 on the turbine rotor body 10. The cooling fluids may first engage the diffuser ramp 18 and slow to the speed of the turbine rotor 18 and enter the inlet orifice 12 into the channel 36. The inlet orifice 12 may be configured to reduce the relative velocity loss associated with cooling fluids entering the inlet orifice 12 in the rotor body 10, thereby availing the cooling system 16 to the efficiencies inherent in pre-swirling the cooling fluids to a velocity that is greater than a rotational velocity of the turbine rotor body 10. As such, the system 16 is capable of taking advantage of the additional temperature and work benefits associated with using the pre-swirled cooling fluids having a rotational speed greater than the turbine rotor body 12.

The foregoing is provided for purposes of illustrating, explaining, and describing embodiments of this invention. Modifications and adaptations to these embodiments will be apparent to those skilled in the art and may be made without departing from the scope or spirit of this invention.

We claim:

1. A turbine rotor, comprising:

a turbine rotor body having at least one cooling chamber forming a portion of a cooling system and having a plurality of rows of turbine blades extending radially from the turbine rotor body, wherein the plurality of rows form a plurality of stages of a turbine engine;

wherein the turbine rotor body is rotationally coupled to at least one stationary component of the turbine engine such that during operation, the turbine rotor body is capable of rotating relative to the at least one stationary component;

wherein the cooling system includes at least one pre-swirl system configured to increase the velocity of cooling fluids within the cooling system to a speed that is at least equal to a rotational speed of the turbine rotor body;

at least one inlet orifice in fluid communication with the at least one pre-swirl system such that the at least one inlet orifice receives cooling fluids from the pre-swirl system;

wherein the at least one inlet orifice includes a diffuser ramp extending generally along an outer surface of the turbine rotor body such that the diffuser ramp extends from an intersection of the outer surface and the turbine rotor body into the turbine rotor body and terminates at the at least one inlet orifice, wherein a volume of the diffuser ramp increases moving from the intersection to the at least one inlet orifice;

wherein the diffuser ramp of the at least one inlet orifice has a width greater than a diameter of the inlet orifice;

wherein at least a portion of the at least one inlet orifice not formed by the diffuser ramp includes a transition section extending radially therefrom a distance greater than an outer diameter of the inlet orifice but less than an outermost extension of the diffuser ramp;

wherein the transition section extends greater than halfway around the inlet orifice; and wherein the diffuser ramp has generally linear sides extending radially from the at least one inlet orifice.

2. The turbine rotor of claim 1, wherein the diffuser ramp of the at least one inlet orifice has a generally linear bottom surface.

3. The turbine rotor of claim 1, wherein the diffuser ramp of the at least one inlet orifice has a generally curved bottom surface extending radially from the at least one inlet orifice.

4. The turbine rotor of claim 1, wherein a channel forming the at least one inlet orifice is generally linear relative to a longitudinal axis of the channel.

5. The turbine rotor of claim 1, wherein a channel forming the at least one inlet orifice is generally curved relative to a longitudinal axis of the channel.

6. The turbine rotor of claim 1, wherein a longitudinal axis of the diffuser ramp is canted relative to a linear axis of the turbine rotor.

7. The turbine rotor of claim 6, wherein the longitudinal axis of the diffuser ramp is aligned with a resultant of a relative velocity vector and an axial velocity vector.

8. The turbine rotor of claim 1, wherein an outlet of the at least one inlet orifice includes an outlet diffuser.

9. The turbine rotor of claim 8, wherein the outlet diffuser is symmetrically wider than a channel forming the at least one inlet orifice in a first direction, and the outlet diffuser is asymmetrically wider than the at least one inlet orifice in a second direction that is generally orthogonal to the first direction, as viewed along an inner surface at the outlet.

10. The turbine rotor of claim 1, wherein the transition section extends about 270 degrees around the inlet orifice.

11. A turbine rotor, comprising:

a turbine rotor body having at least one cooling chamber forming a portion of a cooling system and having a plurality of rows of turbine blades extending radially from the turbine rotor body, wherein the plurality of rows form a plurality of stages of a turbine engine;

wherein the turbine rotor body is rotationally coupled to at least one stationary component of the turbine engine such that during operation, the turbine rotor body is capable of rotating relative to the at least one stationary component;

wherein the cooling system includes at least one pre-swirl system configured to increase the velocity of cooling fluids within the cooling system to a speed that is at least equal to a rotational speed of the turbine rotor body;

at least one inlet orifice in fluid communication with the at least one pre-swirl system such that the at least one inlet orifice receives cooling fluids from the pre-swirl system;

wherein the at least one inlet orifice includes a diffuser ramp extending generally along an outer surface of the turbine rotor body such that the diffuser ramp extends from an intersection of the outer surface and the turbine rotor body into the turbine rotor body and terminates at the at least one inlet orifice, wherein a volume of the diffuser ramp increases moving from the intersection to the at least one inlet orifice;

wherein an outlet of the at least one inlet orifice into the at least one cooling chamber in the turbine rotor body includes an outlet diffuser;

wherein at least a portion of the at least one inlet orifice not formed by the diffuser ramp includes a transition section extending radially therefrom a distance greater than an outer diameter of the inlet orifice but less than an outermost extension of the diffuser ramp;

wherein a longitudinal axis of the diffuser ramp is canted relative to a linear axis of the turbine rotor;

wherein the diffuser ramp of the at least one inlet orifice has a width greater than a diameter of the inlet orifice;

wherein the transition section extends greater than halfway around the inlet orifice; and wherein the diffuser ramp has generally linear sides extending radially from the at least one inlet orifice.

12. The turbine rotor of claim 11, wherein the diffuser ramp of the at least one inlet orifice has a generally linear bottom surface.

13. The turbine rotor of claim 11, wherein the diffuser ramp of the at least one inlet orifice has a generally curved bottom surface extending radially from the at least one inlet orifice.

14. The turbine rotor of claim 11, wherein a channel forming the at least one inlet orifice is generally linear relative to a longitudinal axis of the channel.

15. The turbine rotor of claim 11, wherein a channel forming the at least one inlet orifice is generally curved relative to a longitudinal axis of the channel.

16. The turbine rotor of claim 15, wherein the longitudinal axis of the diffuser ramp is aligned with a resultant of a relative velocity vector and an axial velocity vector.

17. The turbine rotor of claim 11, wherein the outlet diffuser is symmetrically wider than a channel forming the at least one inlet orifice in a first direction, and the outlet diffuser is asymmetrically wider than the at least one inlet orifice in a second direction that is generally orthogonal to the first direction, as viewed along an inner surface at the outlet.

18. The turbine rotor of claim 11, wherein the transition section extends about 270 degrees around the inlet orifice.

19. A turbine rotor, comprising:

a turbine rotor body having at least one cooling chamber forming a portion of a cooling system and having a plurality of rows of turbine blades extending radially from the turbine rotor body, wherein the plurality of rows form a plurality of stages of a turbine engine;

wherein the turbine rotor body is rotationally coupled to at least one stationary component of the turbine engine such that during operation, the turbine rotor body is capable of rotating relative to the at least one stationary component;

wherein the cooling system includes at least one pre-swirl system configured to increase the velocity of cooling fluids within the cooling system to a speed that is at least equal to a rotational speed of the turbine rotor body;

at least one inlet orifice in fluid communication with the at least one pre-swirl system such that the at least one inlet orifice receives cooling fluids from the pre-swirl system;

wherein the at least one inlet orifice includes a diffuser ramp extending generally along an outer surface of the turbine rotor body such that the diffuser ramp extends from an intersection of the outer surface and the turbine rotor body into the turbine rotor body and terminates at the at least one inlet orifice, wherein a volume of the diffuser ramp increases moving from the intersection to the at least one inlet orifice;

wherein an outlet of the at least one inlet orifice into the at least one cooling chamber in the turbine rotor body includes an outlet diffuser;

wherein at least a portion of the at least one inlet orifice not formed by the diffuser ramp includes a transition section extending radially therefrom a distance greater than an outer diameter of the inlet orifice but less than an outermost extension of the diffuser ramp;

wherein a longitudinal axis of the diffuser ramp is canted relative to a linear axis of the turbine rotor such that the longitudinal axis of the diffuser ramp is aligned with a resultant of a relative velocity vector and an axial velocity vector;

wherein the diffuser ramp of the at least one inlet orifice has a width greater than a diameter of the inlet orifice;

wherein the diffuser ramp of the at least one inlet orifice has a generally linear bottom surface;

wherein the outlet diffuser is symmetrically wider than a channel forming the at least one inlet orifice in a first direction, and the outlet diffuser is asymmetrically wider than the at least one inlet orifice in a second direction that is generally orthogonal to the first direction, as viewed along an inner surface at the outlet; and wherein the transition section extends greater than halfway around the inlet orifice.

* * * * *